US009655492B2

(12) United States Patent
Schiavo et al.

(10) Patent No.: US 9,655,492 B2
(45) Date of Patent: May 23, 2017

(54) CENTER-HANDLED LARGE DEBRIS DUST PAN

(71) Applicant: Quickie Manufacturing Corporation, Cinnaminson, NJ (US)

(72) Inventors: Michael A. Schiavo, Mount Ephraim, NJ (US); Jace Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 15/045,788

(22) Filed: Feb. 17, 2016

(65) Prior Publication Data

US 2016/0242618 A1 Aug. 25, 2016

Related U.S. Application Data

(60) Provisional application No. 62/120,439, filed on Feb. 25, 2015.

(51) Int. Cl.
*A47L 13/52* (2006.01)

(52) U.S. Cl.
CPC ..... *A47L 13/52* (2013.01)

(58) Field of Classification Search
CPC ..... A47L 13/52
USPC ..... 15/257.1, 257.5, 257.8, 257.9; D32/74
See application file for complete search history.

(56) References Cited

U.S. PATENT DOCUMENTS

| | | | | | |
|---|---|---|---|---|---|
| 191,368 | A * | 5/1877 | Rennie | A47L 13/52 | 15/257.1 |
| 718,783 | A * | 1/1903 | McIntire | A47L 13/52 | 15/257.8 |
| 881,758 | A * | 3/1908 | Wynkoop | A47L 13/52 | 15/257.7 |
| 2,763,143 | A | 9/1956 | Timmons | | |
| D180,303 | S * | 5/1957 | Timmons | 15/257.1 | |
| 2,812,784 | A * | 11/1957 | Palmer | A47L 13/52 | 118/504 |
| D254,286 | S * | 2/1980 | Daniel | D32/74 | |
| D265,541 | S * | 7/1982 | Messenger | D32/74 | |
| 5,826,297 | A | 10/1998 | Footer et al. | | |
| 2004/0124195 | A1* | 7/2004 | Mensch | B65F 1/14 | 220/212 |
| 2015/0305589 | A1* | 10/2015 | Jacques | A47L 13/52 | 15/257.1 |

FOREIGN PATENT DOCUMENTS

EP 146256 * 6/1985

* cited by examiner

*Primary Examiner* — Mark Spisich
(74) *Attorney, Agent, or Firm* — Husch Blackwell LLP

(57) ABSTRACT

The present invention relates to a dust pan with a handle generally centrally located within the footprint of the dust pan. The handle extends toward the center of gravity of the dust pan to better distribute the weight of the payload during transportation between loading and unloading locations. The dust pan may also incorporate side handles on the upper surface of opposing side walls to provide for enhanced two-handed carrying of heavy loads.

6 Claims, 2 Drawing Sheets

CENTER-HANDLED LARGE DEBRIS DUST PAN

CROSS REFERENCE TO RELATED APPLICATIONS

The present application claims priority to U.S. Provisional Patent Application No. 62/120,439, filed Feb. 25, 2015 titled CENTER-HANDLED LARGE DEBRIS DUST PAN, the entirety of which is hereby incorporated by reference.

FIELD OF THE INVENTION

The present invention relates to a dust pan, and, more particularly, to a dust pan having a main handle extending into the footprint of the dust pan, and side handles for ease of lifting heavy loads.

BACKGROUND OF THE INVENTION

Conventional dust pans generally allow the user to collect debris by holding the dust pan in one hand and operating a broom or the like with the other hand. Such dust pans are generally wide enough to accommodate a long or short handled broom and deep enough to accommodate the typical amount of debris that could be moved by a standard width broom. Further, as will be recognized, most such dust pans include a handle which extends from the back of the dust pan.

However, although conventional dust pans are large enough to handle typical light household cleaning duties, they are too small to accommodate heavier loads from wider brooms such as a shop broom or push broom that would typically be used on a job site. In addition to being too narrow to accommodate a load provided directly by a wider broom, the typical dust pan is relatively shallow and may be difficult to pick up when heavily loaded. These characteristics, combined with a need to dispose of larger, heavier loads, require the user to use a smaller broom and to make multiple trips to the waste bin in order to complete a cleaning job. Alternatively, the user may try to overfill such a conventional dust pan, and simply deal with an unwieldy load.

BRIEF SUMMARY OF THE INVENTION

The present invention relates to a debris dust pan that includes a bottom surface with a rear wall and a front opening. The debris dust pan also includes two side walls which may be lipped, one on either side of the front opening and extending from proximate the front opening to the rear wall. The debris dust pan also preferably includes a center handle located within the footprint of the bottom surface, which extends generally toward the center of gravity of the debris dust pan. Side handles may also be formed along upper edges of the opposed side walls, and anti-skid elements may be positioned on the lower side of the bottom surface. Reinforcing ribs may be located along the front lower lip edge for increased rigidity.

The center handle's position closer to the center of gravity of the debris dust pan within the footprint of the bottom surface allows for better balance as compared to prior art dust pans with handles extending out from the back of the rear wall. Additionally, the side handles make it easier to carry large loads of debris.

Figure 1:
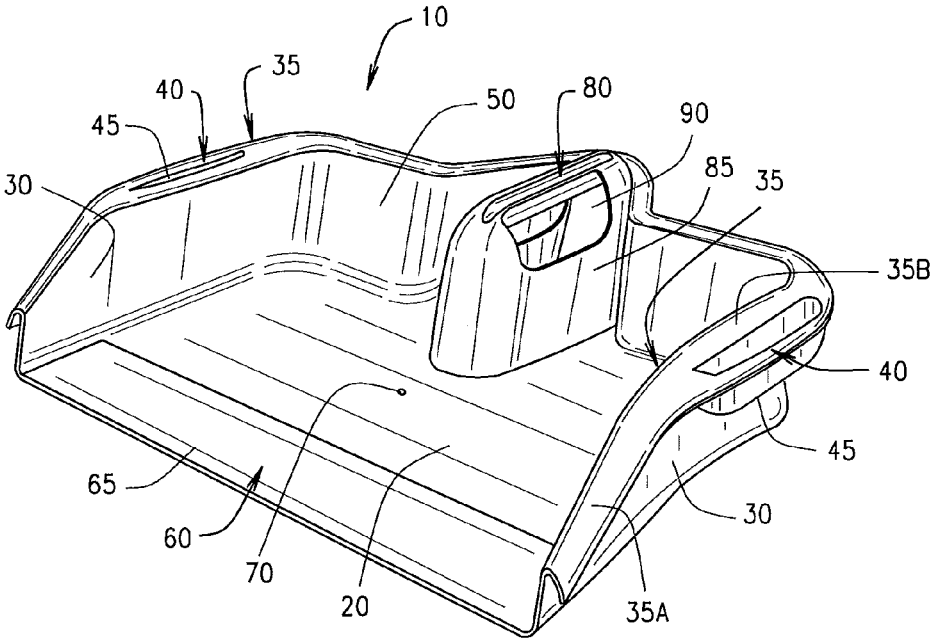
FIG. 1 is a top perspective view of a debris dust pan according to an embodiment of the present invention.

While the disclosure is susceptible to various modifications and alternative forms, a specific embodiment thereof is shown by way of example in the drawing and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

Figure 2:
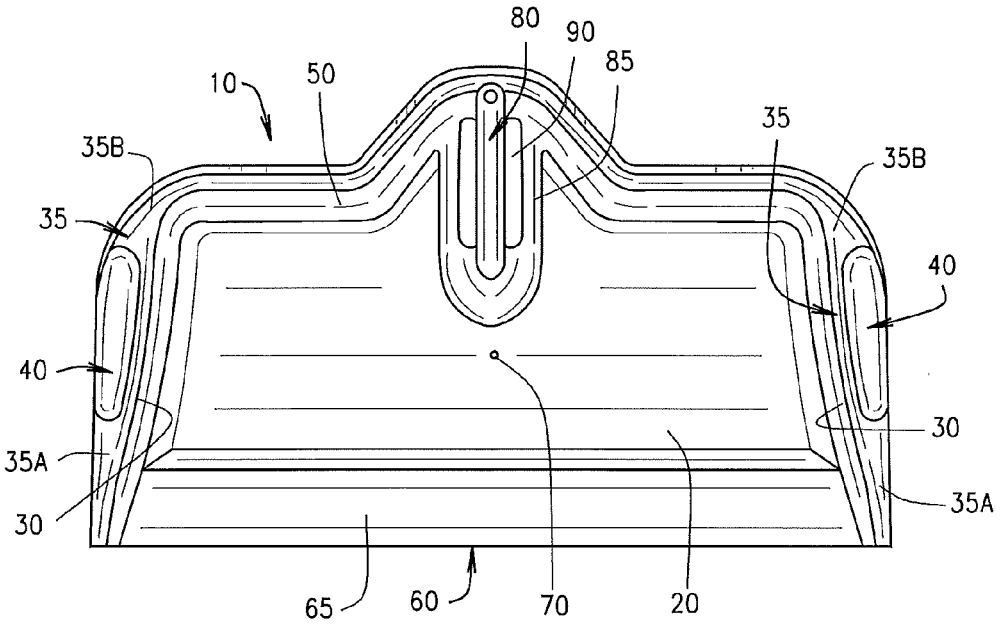
FIG. 2 is a top plan view of the debris dust pan of FIG. 1.

Referring to the drawings particularly by reference numbers wherein like numerals refer to like parts, FIGS. 1 and 2 illustrate the various views of the upper and horizontal surfaces of a debris dust pan 10 having an interior bottom surface 20 with a generally rectangular footprint (as is best seen in FIG. 2). As will be understood, the actual shape of the interior bottom surface 20 may be any desired shape, but a generally rectangular shape is shown in FIGS. 1 and 2. The dust pan 10 also includes side walls 30 on either side of the bottom surface 20. As shown, each side wall 30 includes an upper lip 35 for stability. Each upper lip 35 may include a front portion 35A and a rear portion 35B. Each rear portion 35B of each upper lip 35 preferably includes a side handle 40. As shown, rear portion 35B may be wider than front portion 35 A to accommodate a side handle 40 formed therein. As is also shown, side handle 40 may be formed as a depression 45 in the rear portion 35B of upper lip 35. However, other structures and techniques for forming handles as are known in the art may instead be used.

A rear wall 50 extends generally between the side walls 30, and the side walls extend generally perpendicularly from the rear wall 50 to a front opening 60. Front opening 60 allows for debris to be swept onto the bottom surface 20, where it is contained thereon by the side walls 30 and rear wall 50. Bottom surface 20 may further include a sloped front portion 65 which extends to the front opening 60, to assist the user in moving debris onto the bottom surface 20. As structured, the dust pan 10 has a center of gravity which is approximated by point 70. Of course, it will be understood that the center of gravity may change depending on the specific structure and weighting of the dust pan 10. Further, the exact center of gravity may change when the dust pan 10 is loaded with debris. However, point 70 is used simply as an example, and as a point of reference.

A center handle 80 is preferably located extending from the rear wall 50 into the footprint of the interior bottom surface 20. Preferably, the center handle 80 extends toward and/or to the center of gravity 70 of the dust pan 10. Thus, the center handle 80 preferably extends generally perpendicularly to the rear wall 50 of the dust pan 10, and generally parallel with the side handles 40. As shown, the center handle 80 is formed from an extension 85 of rear wall 50. The extension 85 extends generally perpendicularly from rear wall 50. An opening 90 is provided in the extension 85 to form the center handle 80 thereabove, and to provide clearance for placement of the operator's hand. Alternatively, center handle 80 may be fixedly attached to rear wall 50 in a cantilever fashion thereby requiring no additional opening 90 or extension 85 other than center handle 80. Other structures for forming center handle 80 are also envisioned, as would be known in the art.

By positioning the center handle 80 within the footprint of the bottom surface 20 of the dust pan, extending to and/or towards the center of gravity 70, the dust pan 10 is more balanced when lifted by the center handle 80 even when loaded. Additionally, for very heavy loads, the two side handles 40 which may also be positioned generally on either side of the center of gravity 70 allow for a balanced, two-handed lifting of the dust pan 10.

As noted above, as shown the dust pan 10 includes side walls 30 which each have an upper lip 35. Each such upper lip 35 may be curved outwardly from its respective side wall 30 to form the upper lip 35. Alternatively, upper lips 35 may take the shape of a 90 degree angle as it meets the top of side wall 30, or a "T" shape at the top of side wall 30, or any other suitable structure as would be understood in the art. Alternatively, upper lip 35 may include no front portion 35A, instead having only the rear portion 35B to provide for a location for side handles 40. Alternatively, if side handles 40 are formed by a structure other than a depression 45 in upper lip 35, upper lip 35 may be removed altogether. For a non-limiting example, side handles 40 may be formed simply by creating a void or hole in the side walls 30.

Figure 3:
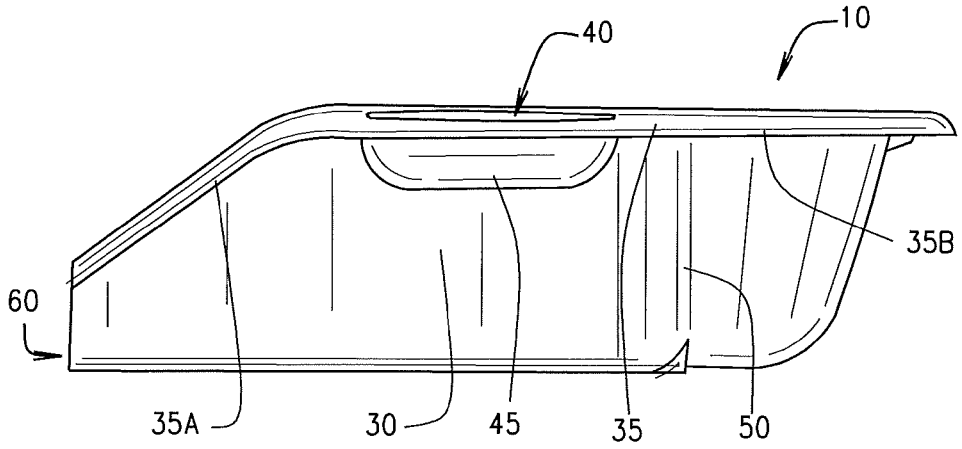
FIG. 3 is a side elevation view of the debris dust pan of FIG. 1.
Figure 4:
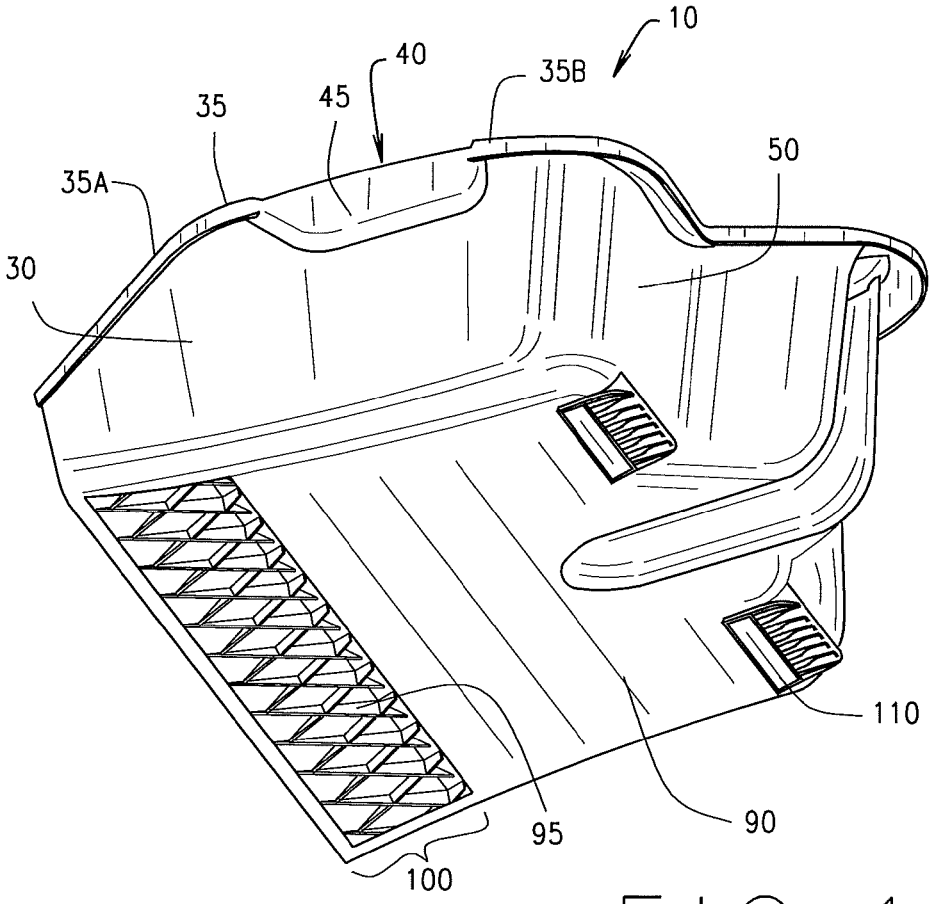
FIG. 4 is a bottom perspective view of the debris dust pan of FIG. 1.

FIGS. 3 and 4 illustrate the exterior and bottom of the dust pan 10. As shown in FIGS. 1, 3 and 4, the side walls 30 may slope downward as it approaches the front opening 60. Alternatively, side walls 30 may remain generally rectangular when viewed from the side, providing no sloped forward portion. FIG. 4 further demonstrates the exterior underside surface 90 of the dust pan 10. As can be seen, reinforcing ribs 95 may also be positioned along the front lower edge 100 of front opening 60. FIG. 4 further demonstrates anti-skid elements 110 which may be fixedly attached to the underside surface 90 of dust pan 10. Such anti-skid elements may be made of rubber or any other suitable material, and may be affixed to the dust pan 10 using adhesive or other comparable fastening method known in the art.

Thus, there has been shown and described several embodiments of a novel large debris dust pan. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A dust pan comprising:

a bottom surface having a footprint;

opposing side walls extending from said bottom surface;

a side wall handle extending from each of said opposing side walls;

a rear wall extending from said bottom surface and between said opposing side walls;

a front opening;

a handle extending from the rear wall into the footprint of the bottom surface toward a center of gravity of the dust pan;

wherein the side wall handle of each side wall extends generally parallel to the handle that extends from the rear wall; and wherein said side wall handles are formed as depressions in an upper lip of each side wall.

2. The dust pan of claim 1 wherein said rear wall handle is formed as an extension from said rear wall.

3. The dust pan of claim 2 wherein an opening through the extension forms the rear wall handle thereabove.

4. The dust pan of claim 1 wherein the side wall handles are positioned on either side of a center of gravity of the dust pan.

5. The dust pan of claim 1 wherein at least one non-skid element is attached to an underside surface of the bottom surface of said dust pan via adhesive bonding.

6. A dust pan comprising:

a bottom surface having a footprint;

opposing side walls extending from said bottom surface, wherein each side wall includes an upper lip extending outwardly from said side wall;

a side wall handle extending from each of said opposing side walls and formed as depressions in the upper lip of each side wall;

a rear wall extending from said bottom surface and between said opposing side walls;

a front opening; and a handle extending from the rear wall into the footprint of the bottom surface.

* * * * *